United States Patent [19]

Stevenson

[11] Patent Number: 5,025,772

[45] Date of Patent: Jun. 25, 1991

[54] BOWSTRING RELEASE DEVICE

[76] Inventor: Mark W. Stevenson, 6518 Swigert Rd., Appleton, N.Y. 14008

[21] Appl. No.: 434,174

[22] Filed: Nov. 13, 1989

[51] Int. Cl.[5] ..... F41B 5/00

[52] U.S. Cl. ..... 124/35.2

[58] Field of Search ..... 124/35 A, 35.2

[56] References Cited

U.S. PATENT DOCUMENTS

| | | | |
|---|---|---|---|
| 2,637,311 | 5/1953 | Rose | 124/35 A |
| 3,853,111 | 12/1974 | Stanislawski et al. | 124/35 A |
| 4,062,339 | 12/1977 | Wilson | 124/35 A |
| 4,066,060 | 1/1978 | Napier | 124/35 A |
| 4,257,386 | 3/1981 | Gazzara | 124/35 A |
| 4,308,851 | 1/1982 | Kaine, Jr. et al. | 124/35 A |
| 4,316,443 | 2/1982 | Giacomo | 124/35 A |
| 4,391,263 | 7/1983 | Dodge | 124/35 A |
| 4,691,683 | 9/1987 | Peck | 124/35 A |
| 4,854,293 | 8/1989 | Roberts | 124/35.2 |

OTHER PUBLICATIONS

Stanislawski release advertisement, "Archery", 8/1976, p. 46.

PSE Catalog (1990), p. 33 (Model Nos. 1801–1804).

*Bear/Jennings* 1990 *Accessories Catalog*, p. 12.

A page from an unknown archery supply magazine discloses the triggerless Stanislawski II, III, and IV releases (Model Nos. 9633, 9634, and 9635, respectively).

*Primary Examiner*—Peter M. Cuomo

*Assistant Examiner*—John A. Ricci

*Attorney, Agent, or Firm*—Robert P. Simpson; Michael L. Dunn

[57] ABSTRACT

A bowstring release device is disclosed which provides greater ease, control and accuracy in the shooting of a bow and arrow. The structure and action of the device inhibits and prevents premature release of the bowstring while being drawn, and enables a smooth, natural and accurate release once the archer has taken aim. The device includes a housing having two members. One member contains holding and release means for the bowstring while the other member includes finger recesses for gripping by the archer. The two members naturally assume a first position relative to one another while the bowstring is being drawn, and this first position prevents release of the bowstring. Once the bowstring is drawn, the archer effectuates release by pivoting the finger grip member of the housing relative to the release member.

8 Claims, 2 Drawing Sheets

BOWSTRING RELEASE DEVICE

BACKGROUND OF THE INVENTION

The present invention relates to a mechanical release device for an archery bow to provide greater ease, control and accuracy in the shooting of a bow and arrow. Such release aids are relatively common, enjoying use by both competition archers and hunters alike.

In general, archery release aids have evolved so as to be characterized as either "trigger" or "triggerless" releases Examples of trigger releases include U.S. Pat. Nos. 4,316,443 (Giacomo), 4,391,263 (Dodge), and 4,062,339 (Wilson) (FIGS. 1-4). A general problem with trigger releases is that they require the dexterity and movement of an additional finger (other than the ones used to draw the bowstring) which usually involves an awkward or at least distracting movement on the part of the archer.

In general, triggerless releases offer improved accuracy and ease of use with respect to trigger releases One such improved release is described in U.S. Pat. No. 3,853,111 (Stanislawski et al.) which utilizes a one-piece grip member which is pivoted to release the bowstring. A general problem with one-piece triggerless releases, however, is that they usually require the archer to move his hand into an unnatural or awkward position to effectuate release. Another specific problem with one-piece pivoting releases is that the release mechanism often exerts a tangential force on the bowstring which adversely affects the archer's accuracy. In an attempt to obtain a "cleaner" release, free from tangential force components, Wilson discloses a two-piece pivoting triggerless release in U.S. Pat. No. 4,062,339 (FIG. 6). The two-piece release of Wilson enables a more natural hand position for the archer and also enables a cleaner, smoother release, free from tangential force components since one piece (extension 31) of the release is always pointed straight toward the target. Unfortunately, the release disclosed in U.S. Pat. No. 4,062,339 (FIG. 6) is also inherently unstable, and requires a safety device to prevent premature release. Moreover, the Wilson release offers no means for adjusting the sensitivity of the release (i.e., the amount of pivoting necessary to effectuate release).

Thus, a need has existed for an archery release device which is natural to hold and use, inherently stable while the bowstring is being drawn (i.e., prevents premature release), and provides greater ease, control and accuracy in the shooting of a bow and arrow.

SUMMARY OF THE INVENTION

A bowstring release device is provided which includes a housing having a first member and a second member, wherein the first member includes at least two finger grip recesses for gripping by fingers of an archer, and one of the recesses extends deeper into the first member than the other recess(es), and the first member is pivotally mounted to the second member. The invention further includes release means secured to the second member and operatively arranged to hold and release a bowstring. Linkage means are provided within the housing operatively arranged to activate the release means to release the bowstring when the first member is pivoted relative to the second member.

A primary object of the invention is to provide a mechanical release device for an archery bow which provides greater ease, control and accuracy in the shooting of a bow and arrow.

A secondary object of the invention is to provide a triggerless release for an archery bow which allows the archer to maintain a natural hand position while releasing the bowstring

Figure 5:
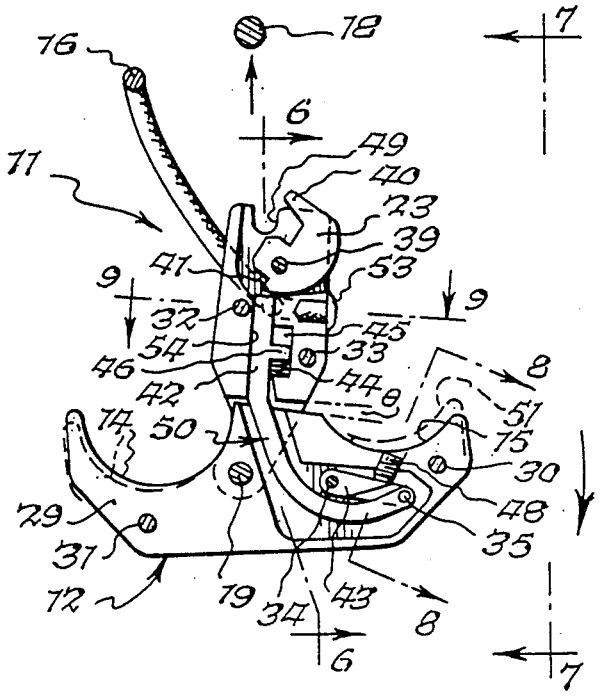
FIG. 5 is a horizontal sectional view of the release device similar to FIG. 3 except showing the device just after the bowstring has been released.

FIG. is a cross-sectional view of the release device taken along plane 9—9 as shown in FIG. 5

DETAILED DESCRIPTION OF THE INVENTION

At the outset, it should be clearly understood that like reference numerals are intended to identify the same structural elements, portions or surfaces consistently throughout the several drawing figures, as such elements, portions or surfaces may be further described or explained by the entire written specification. Unless otherwise indicated, the drawings are intended to be read, (e.g., cross-hatching, arrangement of parts, etc.), together with the specification, and are to be considered a portion of the entire "written description" of this invention. As used in the following description, the terms "left", "right", "up", "down", "top", "bottom", "inward", "outward", "clockwise" and "counterclockwise", as well as adjectival and adverbial derivatives thereof, (e.g., "horizontally", "rightwardly", "upwardly", etc.), refer to the relative orientations of the illustrated structure.

The present invention is an archery release device for use by both competition archers and hunters The device is used to hold a bowstring while being drawn by the archer, and to release the bowstring once the archer has achieved the proper aim. The device is held in a natural position by the archer while drawing the bowstring, and a smooth release is effectuated by a slight pivoting action imparted to the device by the archer's hand, primarily through his middle and index fingers. In a preferred embodiment, release is effected by exerting more torque by the middle finger than the index finger. The sensitivity of the release is adjustable to accommodate a varying pivoting angle necessary to release the bowstring.

The claimed release device includes at least two features which contribute to the natural and controlled release of the bowstring. Specifically, the inventor has discovered advantages in including a deeper index finger recess in the handgrip as opposed to the middle finger recess, and has discovered a geometry for the release which inhibits and prevents a premature release of the bowstring. (A premature release is a release which occurs while the bowstring is being drawn but before the archer has finished taking aim.)

Broadly, then, the release device includes gripping means through which a hand applies drawing force to the bowstring, where the gripping means include at least an index finger recess for gripping by an index finger and a middle finger recess for gripping by a middle finger, where the index finger recess extends deeper into the gripping means than the middle finger recess to reduce force applied by the index finger relative to the middle finger when drawing force is applied to the gripping means. In other words, the force applied by the archer's index finger is less than the force that would be applied if the index finger recess was not deeper than the middle finger recess. The release device is operatively arranged to prevent premature release of the bowstring by application of more force by the index finger than by the middle finger to the gripping means in the absence of an engaged safety mechanism preventing such release.

Figure 1:
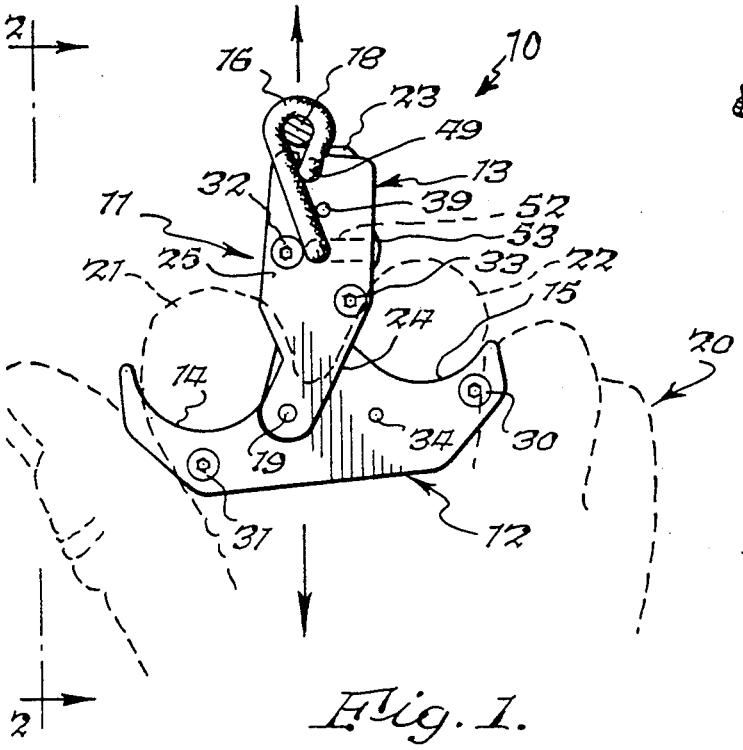
FIG. 1 is a top plan view of the bowstring release device shown as held in use drawing and holding a bowstring.

The following description is of a preferred embodiment of the invention, and should in no way be considered as the only means to practice the invention as defined by the claims. For example, the device described herein is constructed entirely of metal (except for the release rope). However, even though a preferred embodiment as described herein is constructed of machined steel and aluminum, etc., it should be readily apparent that many materials may be used or substituted for the metal parts described herein. For example, the housing could be constructed of plastic or wood, etc., and the release rope may be any cord, string, twine, etc., strong enough to withstand the forces exerted by the bowstring. Indeed, the release rope itself is optional, in that the bowstring can be held directly by the release means within the housing as described in more detail infra. Although a preferred embodiment is shown as being used by a right hand of an archer, obviously the device could be "flipped over" and used by a left hand as well. The invention is not limited to a device having only two finger recesses as shown in the drawings, since other recesses can be added for gripping by additional fingers without adversely affecting operation of the release. Adverting now to the drawings, FIG. 1 is a top plan view of bowstring release device 10 shown as held by an archer's hand 20 while drawing and holding bowstring 18. The arrow at the top of FIG. 1 illustrates the upward force exerted on device 10 by bowstring 18, and also generally indicates the direction in which an arrow (not shown) would be propelled by bowstring 18. Similarly, the arrow at the bottom of FIG. 1 illustrates the downward force which must necessarily be exerted by the archer's hand on device 10 to draw bowstring 18.

Release device 10 broadly includes housing 11 which comprises first member 12 and second member 13. Members 12 and 13 are pivotally secured to one another at pivot pin 19. First member 12 includes first finger recess 14 and second finger recess 15. In a preferred embodiment, device 10 is shown as being held by two fingers, an index finger 21 in first recess 14 and a middle finger 22 in second recess 15. It should be readily apparent, however, that first member 12 may be extended leftwardly or rightwardly to add additional finger recesses so that the device may be held by any desired combination of an archer's fingers.

Figure 3:
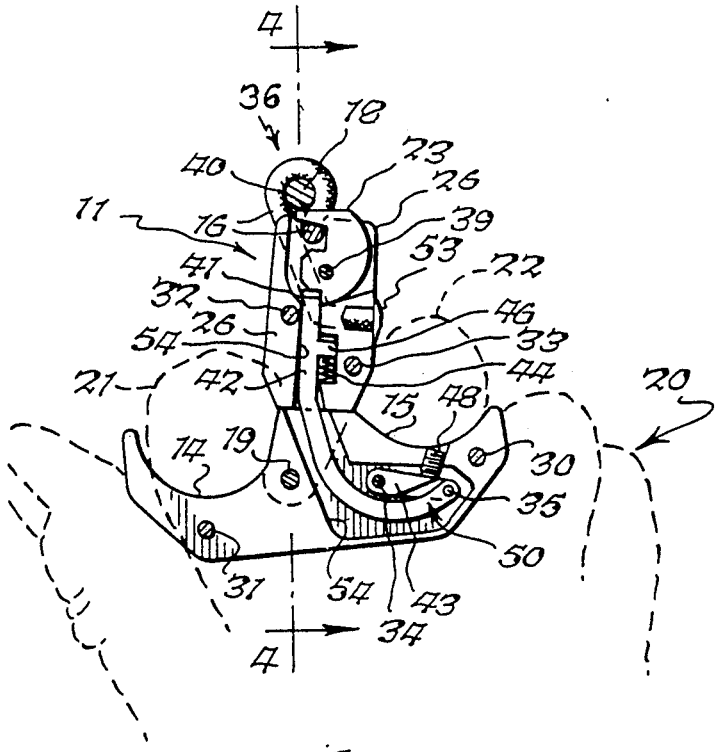
FIG. 3 is a horizontal sectional view of the release device taken along plane 3—3 as shown in FIG. 2.

To operate release device 10, the archer first secures release rope 16 around bowstring 18 and locks the bowstring in place with locking cam 23 (shown in FIGS. 1 and 3). It should be noted that release rope 16 may be wrapped about bowstring 18 in either direction. Thus, although the release rope is shown as wrapped about the bowstring in a clockwise direction in the drawings, it could equally well be wrapped in a counterclockwise direction and still function properly. After securing the release rope, the archer then places his hand in the release as shown in FIG. 1, with index finger 21 in first finger recess 14 and middle finger 22 in second finger recess 15. As mentioned previously, the archer then draws the bowstring in the direction of the arrow at the bottom of FIG. 1. As the bowstring is drawn, it is critical that the archer apply slightly more torque to finger recess 14 than to finger recess 15 to prevent a premature release. The unique design of the release, however, renders it extremely difficult to cause a premature release. In fact, the geometry and interaction of the individual components of the release ensure that natural action of the archer's hand inhibits and prevents a premature release. Specifically, it will be noted with respect to FIG. 1 that first recess 14 extends deeper into first member 12 than second recess 15. In fact, first recess 14 extends deeper into member 12 than second recess 15 by a distance which is approximately equal to the average difference in length in a mature adult hand between a length of an index finger from a first knuckle to a second knuckle and a length of a third digit on the same hand from a first knuckle to a second knuckle. This design feature, in conjunction with the geometry and mechanical action of two-piece housing 11 ensures that greater torque will naturally be applied to recess 14 as opposed to recess 15 while the bowstring is being drawn so as to prevent premature release.

As yet an added safeguard, it will be noted that an imaginary longitudinal centerline extending through second member 13 would lie in a direction which is displaced in a clockwise direction with respect to the top and bottom arrows of FIG. 1. During the drawing of the bowstring, the equilibrium force position occurs when this imaginary longitudinal centerline is coincident with the top and bottom arrows of FIG. 1. It is therefore naturally required that more force be applied to recess 14 than to recess 15 to achieve equilibrium. Since release is achieved by pivoting member 12 in a clockwise direction about pivot pin 19 with respect to member 13, the natural forces at work in drawing the bowstring tend to ensure substantial contact between the surfaces of members 12 and 13 at interface 24, and prevent premature release.

Figure 2:
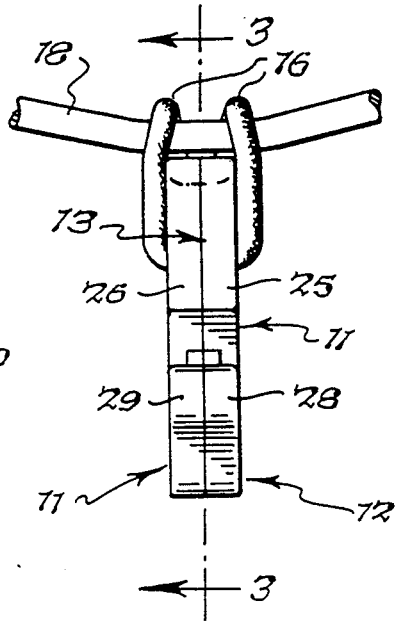
FIG. 2 is a side elevation of the release device taken along plane 2—2 as shown in FIG. 1.

Once the bowstring has been drawn and the archer has taken aim, release is achieved by pulling downward on recess 15 with middle finger 22. This causes a clockwise pivoting of member 12 about pivot pin 19 with respect to member 13, which results in a visible gap between members 12 and 13 at interface 24, and activates the internal release means of the device FIG. 2 is a side elevation of the release device taken along plane 2—2 is shown in FIG. 1, and shows clearly how release rope 16 holds bowstring 18. FIG. 2 also illustrates that first member 12 comprises first top member 28 and first bottom member 29. Members 28 and 29 are held together by flathead hex allen screws 30 and 31 (shown in FIG. 1). Second member 13 is shown as comprising second top member 25 and second bottom member 26. Members 25 and 26 are held together by flathead hex allen screws 32 and 33 (shown in FIG. 1).

FIG. 3 is a horizontal sectional view of the release device taken along plane 3—3 as shown in FIG. 2. FIG. 3 illustrates the device in the locked or holding position. Bowstring 18 is shown as being held by release means 36 which comprises rotatable locking cam 23 in combination with release rope 16. Cam 23 is shown as lying in cavity 38 (shown in cross-section in FIG. 4) of second bottom member 26, and is further shown as pivotally secured to member 26 by pivot pin 39. A similar cavity exists in second top member 25 and pivot pin 39 is fixedly secured to both members 25 and 26. Cam 23 includes catch 40 which traps release rope 16 when cam 23 is rotated in a counterclockwise direction about pivot pin 39. In the holding position, release rope 16 is looped about bowstring 18 and is trapped in rounded groove 49 (shown in FIGS. 1, 4, 5 and 6) of second top member 25 and second top member 26. It will be readily appreciated that release rope 16 is optional in that groove 49 may be made large enough to hold bowstring 18 directly. In the preferred embodiment shown, however, bowstring 18 exerts an upward force on release rope 16, which in turn pulls upwardly on the lower sloped surface of catch 40, urging cam 23 to rotate clockwise to release rope 16 and bowstring 18.

Linkage means 50 comprises arcuate link 42, straight link 43 and spring 44. Arcuate link 42 lies in J-shaped cavity 54 within members 12 and 13, and is pivotally secured to straight link 43 at pivot pin 35. Straight link 43 is pivotally secured to pivot pin 34 which is rigidly secured to first member 12. In the holding position, the upper portion of arcuate link 42 is urged upwardly by spring 44 which is mounted in a generally rectangular cavity 45 of members 25 and 26 (see FIG. 5). Spring 44 exerts an upward force on arm 46 of arcuate link 42, causing the top portion of link 42 to impinge upon flange surface 41 of cam 23 preventing clockwise rotation of the cam.

Figure 8:
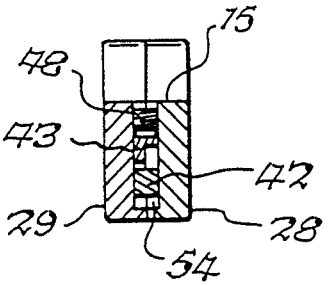
FIG. 8 is a cross-sectional view of the release device taken along plane 8—8 as shown in FIG. 5.

The amount of surface area of flange surface 41 in contact with the upper portion of link 42 may be adjusted by sensitivity adjustment set screw 48 which is threaded into a threaded through-bore in finger recess 15 of second member 12 (shown in cross-section in FIG. 8). As set screw 48 is turned in a clockwise direction, it advances deeper into its threaded through-bore, urging straight link 43 to rotate in a clockwise direction about pivot pin 34. This rotational movement is converted to translational movement by arcuate link 42 which moves downwardly to further compress spring 44 as straight link 43 rotates clockwise. As arcuate link 42 moves downwardly, a lesser surface area of flange surface 41 is in contact with the upper portion of arcuate link 42. Thus, by turning set screw 48 in a clockwise direction, the release device is said to have a greater sensitivity, since a smaller pivot angle between first and second members 12 and 13, respectively, will be required to release the bowstring. Conversely, turning set screw 48 in a counterclockwise direction decreases the sensitivity of the release device. In the vernacular language of archery, greater sensitivity is often referred to as a "quicker" or "lighter" release action, whereas lesser sensitivity is often described as a "slower" or "heavier" release action.

Figure 4:
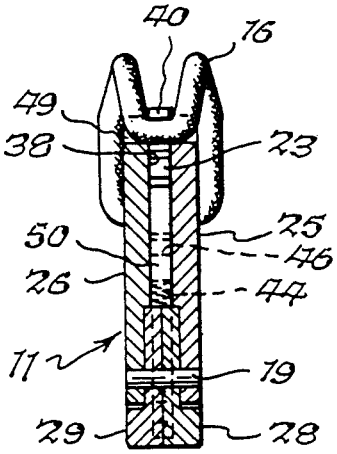
FIG. 4 is a cross-sectional view of the release device taken along plane 4—4 as shown in FIG. 3.

FIG. 4 is a cross-sectional view of the whole release device taken along plane 4—4 as shown in FIG. 3.

FIG. 5 is a horizontal sectional view of the release device similar to FIG. 3 except showing the device just after the bowstring has been released. The dotted outline 51 is meant to illustrate the position of first member 12 prior to being pivoted in a clockwise direction by fingers 21 and 22 (in the direction of the arrow to the right of FIG. 5)

FIG. 5 illustrates the relatively small pivot angle Θ between members 12 and 13, respectively, which is necessary to effectuate release of the bowstring. Pivot angle Θ may be made smaller by turning set screw 48 in a clockwise direction, and may be made larger by turning set screw 48 in a counter-clockwise direction.

To effectuate release, first member 12 is pivoted clockwise with respect to second member 13 about pivot pin 19. When pivot angle Θ is reached, bowstring 18 is released. As first member 12 is pivoted in a clockwise direction, so also does pivot pin 34 rotate in a clockwise direction about pivot pin 19, since pivot pin 34 is fixedly secured to first member 12. At all times during holding and release, straight link 43 is kept in substantial contact with set screw 48 by the force of spring 44 exerted through arcuate link 42. In other words, pivot pin 35 is continuously urged upwardly by the force exerted by spring 44, which tends to keep straight link 43 in contact with set screw 48. As member 12 pivots clockwise, so also does pivot pin 35 rotate clockwise with respect to pivot pin 19, causing arcuate link 42 to move downwardly away from straight link 43. Arcuate link 42 converts the rotational pivot action of the release into translational movement, since a clockwise rotation of member 12 with respect to member 13 causes the top straight portion of arcuate link 42 to move downwardly within J-shaped cavity 54 causing further compression of spring 44 by arm 46.

As shown in FIG. 5, the top portion of arcuate link 42 eventually moves downwardly far enough such that cam 23 is no longer prevented from rotating in a clockwise direction. At this point the upward force of bowstring 18 exerted upon catch 40 by release rope 16 causes cam 23 to suddenly rotate clockwise so as to release the bowstring.

Once the bowstring has been released, the release device may be reset by again looping release rope 16 about the bowstring and by rotating catch 40 counterclockwise to trap rope 16 in groove 49. It should be appreciated, with reference to FIGS. 3 and 5 that, as catch 40 is closed, the force exerted by spring 44 on arcuate link 42 tends to rotate member 12 counterclockwise to the original holding position.

Figure 6:
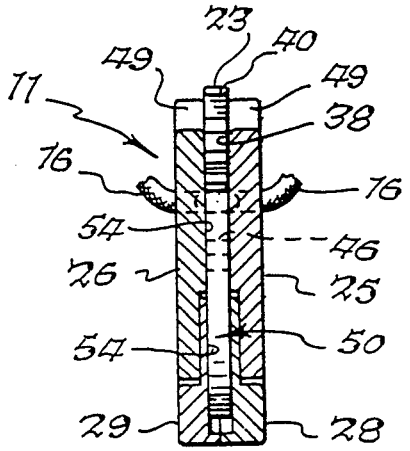
FIG. 6 is a horizontal sectional view of the release device taken along plane 6—6 as shown in FIG. 5.

FIG. 6 is a horizontal sectional view of the whole release device taken along plane 6—6 as shown in FIG. 5.

Figure 7:
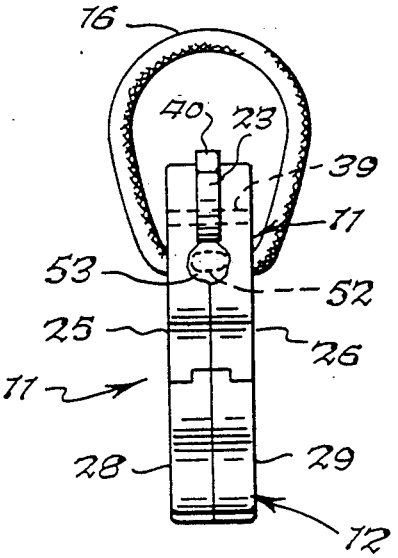
FIG. 7 is a side elevation of the release device taken along plane 7—7 as shown in FIG. 5.

FIG. 7 is a side elevation of the whole release device taken along plane 7—7 as shown in FIG. 5. FIG. 7 particularly illustrates elliptical through-bore 52 which passes through members 25 and 26. The terminal ends of release rope 16 extend through through-bore 52 and are flared and cemented together to form mass 53 which is occluded from passing inwardly through through-bore 52.

As mentioned previously, FIG. 8 is a cross-sectional view of the release device taken along plane 8—8 as shown in FIG. 5. FIG. 8 shows in cross-sectional detail the relative positions of sensitivity adjustment set screw 48, straight link 43 and arcuate link 42.

Figure 9:
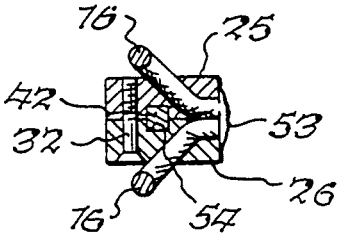

FIG. 9 is a cross-sectional view of the release device taken along plane 9—9 as shown in FIG. 5, and illustrates clearly how the terminal ends of release rope 16 are joined together into flared mass 53 which is too large to pass through through-bore 52. FIG. 9 also shows the upper section of arcuate link 42.

It will thus be seen that the objects set forth above, among those made apparent from the preceding description, are efficiently obtained. Since certain changes may be made in carrying out the above invention and in the constructions set forth without departing from the scope of the invention, it is intended that all matter contained in the above description or shown in the accompanying drawings be interpreted as illustrative and not in a limiting sense. It is also to be understood that the following claims are intended to cover all of the generic and specific features of the invention herein described, and all statements of the scope of the invention, which, as a matter of language, might be said to fall therebetween.

What is claimed is:

1. A bowstring release device, comprising:

a housing having a first member and a second member, wherein said second member has an imaginary longitudinal centerline, and wherein said first member includes at least two finger grip recesses for gripping by fingers of an archer, wherein a first recess on one side of said centerline located closet to said centerline extends deeper into said first member than a corresponding closet second recess on the other side of said centerline, and wherein said first member is pivotally mounted to said second member;

release means secured to said second member and operatively arranged to hold and release a bowstring; and linkage means within said housing operatively arranged to activate said release means to release said bowstring when said first member is pivoted relative to said second member, wherein said linkage means comprises a partially arcuate link pivotally mounted within said first member which functions to transform rotational motion caused by said pivoting of said first member relative to said second member into translational motion of said link which releasably engages said release means.

2. A device as recited in claim 1 and including means for adjusting a pivot angle between said first and second members necessary to release said bowstring.

3. A device as recited in claim 1 wherein said first recess extends deeper into said first member than said second recess by a distance approximately equal to an average difference in length in an adult hand between a length of an index finger from a first knuckle to a second knuckle and a length of a third digit on the same hand from a first knuckle to a second knuckle.

4. A device as recited in claim 3 wherein a relative position of said first and second recesses functions to maintain said release device in a stable position as said bowstring is drawn so as to prevent a premature release of said bowstring.

5. A device as recited in claim 1 wherein said release means comprises a rotatable locking cam.

6. A device as recited in claim 1 wherein said release means comprises a rotatable locking cam in combination with a release rope.

7. A device as recited in claim 1 wherein said bowstring is arranged to propel an arrow in a first direction and wherein said second member has an imaginary longitudinal centerline which is initially displaced from said first direction and wherein drawing said bowstring by pulling on said finger grip recesses tends to align said centerline with said first direction and also prevents said release device from prematurely releasing said bowstring.

8. A device as recited in claim 1 wherein said linkage means comprises an arcuate link pivotally mounted within said housing which functions to transform rotational motion caused by said pivoting of said first member relative to said second member into translational motion of said link which releasably engages said release means.

* * * * *

UNITED STATES PATENT AND TRADEMARK OFFICE

CERTIFICATE OF CORRECTION

PATENT NO. : 5,025,772

DATED : June 25, 1991

INVENTOR(S) : Mark W. Stevenson

It is certified that error appears in the above-identified patent and that said Letters Patent is hereby corrected as shown below:

Column 7, claim 1, lines24 and 26, substitute "closet" with the word --closest--.

Signed and Sealed this

Thirteenth Day of October, 1992

*Attest:*

DOUGLAS B. COMER

*Attesting Officer*

*Acting Commissioner of Patents and Trademarks*